US005455068A

United States Patent [19]

Aves et al.

[11] Patent Number: 5,455,068

[45] Date of Patent: Oct. 3, 1995

[54] METHOD FOR TREATING CONTINUOUS EXTENDED LENGTHS OF TUBULAR MEMBER INTERIORS

[76] Inventors: William L. Aves, Jr., 1703 Hilltop La., Arlington, Tex. 76013; Gary A. Aves, 2600 Partridge La., Arlington, Tex. 76017

[21] Appl. No.: 233,919

[22] Filed: Apr. 28, 1994

[51] Int. Cl.[6] ..... C23C 10/46; C23C 8/70

[52] U.S. Cl. ..... 427/237; 427/253; 427/239; 148/279

[58] Field of Search ..... 148/279; 427/253, 427/239, 237

[56] References Cited

U.S. PATENT DOCUMENTS

| | | | |
|---|---|---|---|
| 2,801,187 | 7/1957 | Galmiche . | |
| 3,090,702 | 5/1963 | Commanday | 148/279 |
| 3,286,684 | 11/1966 | Aves . | |
| 3,673,005 | 6/1972 | Kunst | 148/229 |
| 3,787,245 | 1/1974 | Kunst | 148/279 |
| 3,842,921 | 10/1974 | Dill et al. . | |
| 3,891,474 | 6/1975 | Grange . | |
| 3,922,038 | 11/1975 | Scales . | |
| 3,923,348 | 12/1975 | Peck . | |
| 3,936,327 | 2/1976 | Fichtl | 148/279 |
| 4,126,488 | 11/1978 | Kunst | 427/253 |
| 4,237,184 | 12/1980 | Gonseth et al. . | |
| 4,389,439 | 6/1983 | Clark et al. . | |
| 4,495,005 | 1/1985 | Aves, Jr. . | |
| 4,495,006 | 1/1985 | Aves, Jr. et al. . | |
| 4,539,053 | 9/1985 | Aves, Jr. . | |

*Primary Examiner*—Sam Silverberg

*Attorney, Agent, or Firm*—Bell, Seltzer, Park & Gibson

[57] ABSTRACT

A chemical vapor deposition method is provided for case hardening a ferrous metal interior tubular surface by exposure to diffusible boron with or without other diffusible elements such as silicon to enhance the wear, abrasion and corrosion resistance of the surface. The pack composition used allows for borosiliconizing of the interior surface without sintering or adhering to itself and/or adhering to the surface. The pack composition comprises between about 5% and about 20% by weight of a suitable source of boron; between about 2% and about 10% by weight of silicon material; between about 2% and about 15% by weight of an activator; and the balance being a non-sintering, non-adhering filler. The pack composition is substantially free of diffusible carbon thereby minimizing carburization of the interior surface of the tubular member, and remains free-flowing after the heating and cooling steps, to permit the treatment of continuous lengths of the interior surface of the tubular member whereby the pack composition flows freely from the tubular member interior after the treatment.

13 Claims, 1 Drawing Sheet

METHOD FOR TREATING CONTINUOUS EXTENDED LENGTHS OF TUBULAR MEMBER INTERIORS

FIELD OF INVENTION

The present invention relates to a method for treating continuous lengths of tubular member interiors, and more particularly, to a chemical vapour deposition method of applying a boronized layer with or without other diffusible elements to the interior surface of a long tubular member using a non-adhering pack composition.

BACKGROUND OF INVENTION

It is common to use tubular apparatus in fluid handling systems. In many such systems, the tubular apparatus is subjected to wear, abrasion and corrosion primarily due to the abrasiveness of the material transported, the ambient temperature and chemical degradation. In severe uses, such as in the process of pumping oil from oil wells, the interior surfaces of the tubing and other components are exposed to highly abrasive and corrosive elements, such as hydrogen sulfide and sulfuric acid, for example. The pumping of oil creates an environment laden with corrosive and abrasive matter, often at both high and low temperatures.

There is disclosed in the prior art methods of providing a resistant coating or layer on a metal surface so as to increase the wear, abrasion and corrosion resistivity of the surface. For example, it is known from U.S. Pat. No. 2,801,187 (Galmiche et al.) that a resistant metal layer can be created on surfaces by chemical vapour deposition of the metal. In that patent, the method disclosed requires two distinct halide sources and the pack compositions used create layers that include any of the following metals: chromium, aluminium, nickel and molybdenum.

In U.S. Pat. No. 3,842,921 (Dill et al.) a method for making a wear-resistant boron drill is disclosed. The method includes carburizing a metal surface with a layer containing significant amounts of carbon, and then boronizing the carburized layer. The resultant product is then hardened and tempered. U.S. Pat. No. 3,923,348 (Peck) also discloses a method in which a carburized layer is formed, followed by a boronized layer. Both of these patents relate to the treatment of outside surfaces of metal parts.

U.S. Pat. No. 4,495,005 (Aves, Jr.) discloses a method for carburizing and borosiliconizing a metal surface. The method includes the step of exposing the metal surface to diffusible carbon, boron and silicon found in a single pack composition at different stages during a single thermocycle. The temperature is controlled so that in the initial stage only carburizing of the metal surface occurs, whereas in the subsequent stages, boronizing and siliconizing occur. As such, two or more distinct layers are formed on the metal surface. The method disclosed in U.S. Pat. No. 4,495,005 is directed to the treatment of outside surfaces. The method is not useful for treating tube interior surfaces, because the pack tends to adhere during the chemical vapor deposition process because the barium and calcium oxides present in the pack adhere to form a cohesive pack which is no longer free flowing.

U.S. Pat. No. 4,389,439 (Clark et al.) discloses a method for treating the inner surface of a pipe by forming a dual layer on the inner surface. The first layer consists mostly of iron carbide formed by carburizing or carbonitriding. This is done by contacting the inner surface of the tubes with a carbon source for five hours at 1625° F. The inside surface of the tubing is then exposed to a boronizing pack comprising 2% –10% boron powder, a halogen activator and aluminum oxide filler. This pack is heated for 8 hours at 1650° F., however, since this pack contains a major portion of aluminum oxide, the pack will sinter, or least the pack will adhere to itself and/or adhere to the inner surface of the tube. Thus, after treatment of the inside surface is completed, the adhered pack can only be removed from the tube interior by breaking up the adhered pack. As such, only localized areas of the tube interior can be treated at one time, rather than treating the entire length of a long tube.

A chemical vapour deposition method has been provided in the prior art for treating an interior surface of a ferrous tubular member to provide abrasion and corrosion resistance to the surface. In the process of the prior art, the surface to be treated is exposed to a pack composition, and both are heated to a temperature where at least one carburized, boronized or siliconized layer is formed on the surface by chemical vapour deposition. Preferably, a first carburized or carbonitride layer is formed, followed by a boronized and/or siliconized layer.

In this specification, the term "adheres" is used to refer to the condition where the pack composition either sinters, or it adheres to itself and/or adheres to the tubular member's surface. Thus, in order for the adhered pack composition to be removed from the tubular member, it must be broken up since the pack composition is not free-flowing. Therefore, by "adhered pack composition", it is meant that the pack composition no longer is free-flowing and that it must be broken up before it can be removed from the interior of the tubular member. In addition, tubular member is intended to include any tubular elongate hollow member of extended length, normally longer than 4 feet.

Accordingly, it would be advantageous to provide a method for treating the entire length of an inner surface of a long tubular member.

SUMMARY OF THE INVENTION

It is an object of an aspect of the present invention to provide a method for case hardening a ferrous metal interior tubular surface. In the process of the present invention, the interior tubular surface is exposed to a diffusible source of boron in combination with or without other diffusible elements to enhance the wear, abrasion and corrosion resistance of the surface. The pack composition used with the process of the present invention allows for boriding the interior surface without sintering or adhering to itself and/or adhering to the surface.

In one aspect of the present invention, an improved method for treating continuous extended lengths of tubular member interior surfaces comprises:

providing a non-sintering, non-adhering, free-flowing powder pack composition, comprising:

i) between about 5% and about 20% by weight of a suitable source of boron;

ii) between about 2% and about 15% by weight of an activator; and iii) the balance being a non-sintering, non-adhering filler; said powder pack composition being substantially free of diffusible carbon thereby minimizing carburization of the interior surface of the tubular member, and the powder pack composition is substantially non-sintering and non-adhering thereby remaining free-flowing after the heating and cooling steps, the free flowing pack composition permitting the treatment of continuous lengths of the interior surface of the tubular member whereby the pack composition flows from the tubular member interior after the treatment.

DESCRIPTION OF THE PREFERRED EMBODIMENT

Figure 1:
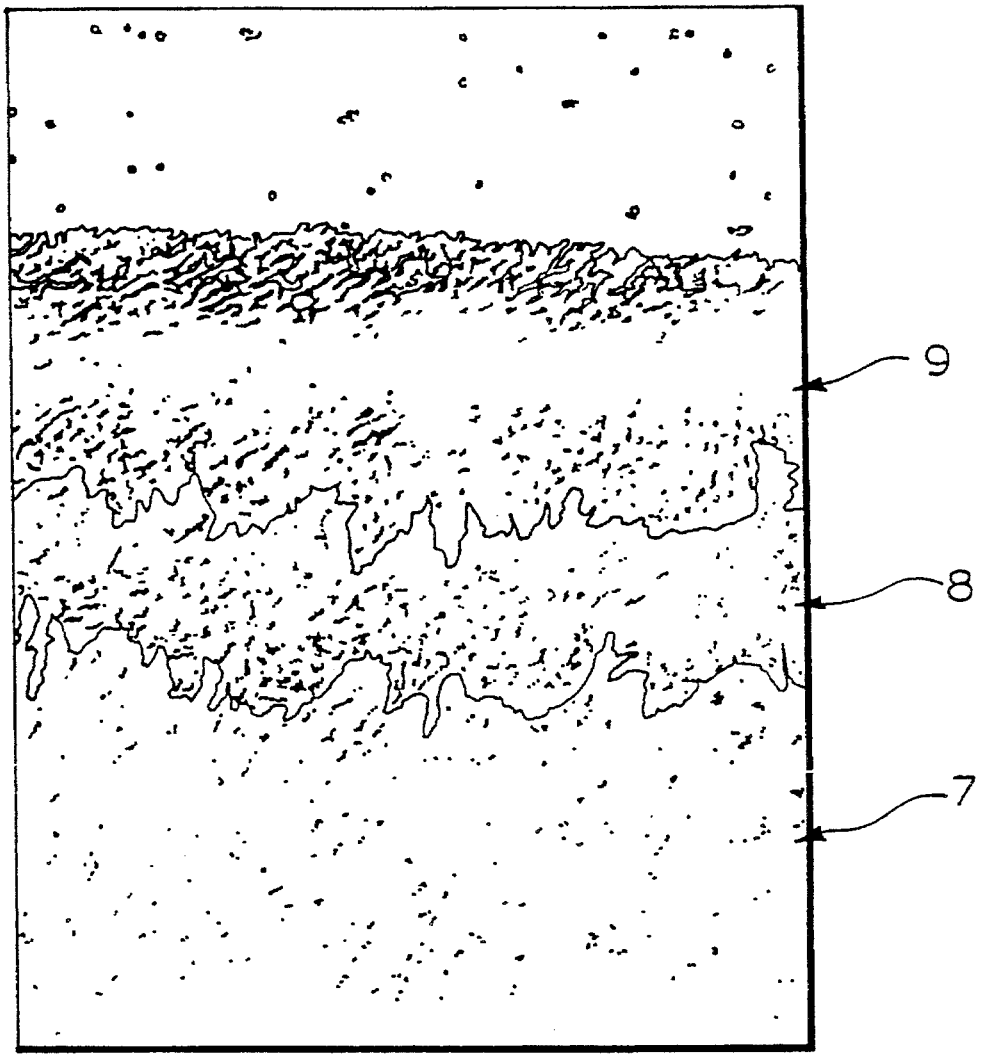
FIG. 1 is a photomicrograph of a boron and silicon case applied to the interior surface of a 31 foot long, 2 inch diameter tube by the method of the present invention.

With reference to FIG. 1, there is shown a photomicrograph of a chemical vapor deposited case applied to the interior surface of a ferrous tubular member 7 using the method of the present invention. The present invention may be used with different types of ferrous tubular members, including coiled tubes. The tubular member 7 may be of 1018 steel.

It is appreciated that several different types of inorganic materials may be chemically vapor deposited on the interior surface of the tube. For purposes of providing the desired case hardness on the interior of the tube, boron is the material of choice. It is appreciated that several other chemical vapor deposited materials may be used in conjunction with boron. Such materials include silicon, chromium, vanadium, titanium and the like, sources of which may also be included in the pack composition. In accordance with an embodiment of the invention an interior case of boron/silicon is most preferred. In respect of the detailed discussion of the preferred embodiments of FIGS. 1 and 2, the case of a boron/silicon deposited material shall be described. With respect to the preferred embodiment of FIG. 1 involving a boron/silicon case, the intermediate phase 8 and the boron/silicon case is composed predominantly of $Fe_2B$ with some iron silicide (FeSi) and $B_6Si$ present. The surface phase 9 is composed predominantly of FeB, $B_3Si$, and FeSi. Thus, in the embodiment illustrated in FIG. 1, two borosilicide layers were formed on the surface of the tubular member 7 using the method of the present invention.

In accordance with the chemical deposition method of the present invention, both the intermediate phase 8 and the surface phase 9 are diffusion bonded to each other and to the steel substrate 7. In the example illustrated in FIG. 1, the preferred boron/silicon case had an average thickness of between 0.016 inches and 0.017 inches. The tubular member 7 had a length of 31 feet and had an inside diameter of 2 inches.

Figure 2:
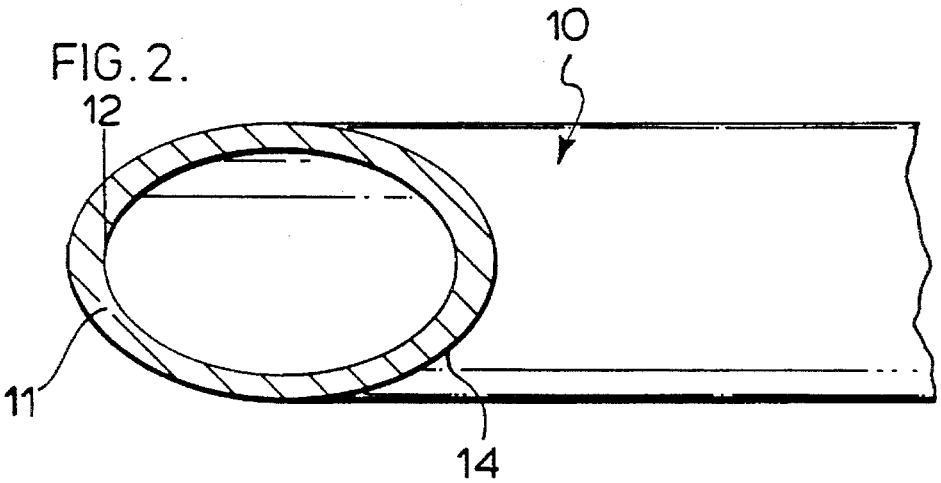
FIG. 2 is an angled cross-section of a tube on which a preferred boron and silicon case is applied with the method of the present invention.

Now referring to FIG. 2, a ferrous metal tubular member 10 is illustrated. The tubular member 10 may be a tube of preferably a low carbon or alloy steel base metal 11. The inner surface of the tube 10 has been treated with the method of the present invention to create the preferred boron/silicon case, generally designated with the numeral 12 as seen in FIG. 2. The case 12 includes an intermediate layer and a surface layer as per the section of FIG. 1. It will be understood that the transition between the base metal 11, the intermediate layer and the surface layer is continuous and gradual due to the method described hereinafter. It is appreciated that the exterior 14 of the tube may be treated in a similar fashion to provide an exterior boronized/siliconized exterior.

The borosiliconized case 12 creates a layer at the surface of the tubular member 10 of exceptional hardness for resistance to wear, abrasion and corrosion. It is known in the art that boronizing provides a metal surface with exceptional wear resistance, whereas siliconizing provides excellent corrosion and acid resistance properties, particularly in the presence of boron. For example, silicon is particularly resistant to hydrogen sulfide and sulfuric acid, two compounds commonly encountered in drilling an oil well. We have found that either or both diffusible materials can be properly deposited on tube interior to form a hard case in presence of a free flowing non-sintering pack.

The method of the present invention uses what is commonly referred to as chemical vapour deposition (CVD) or pack cementation. Chemical vapour deposition is a method for depositing continuous, uniform metallurgically bonded metallic or intermetallic coatings to most metallic and carbonaceous substrates. In that process, coating elements are transferred to a substrate by means of a chemical reaction coincident with or followed by solid state diffusion. Chemical vapour deposition and sintering pack cementation has been employed for various diffusible elements which provide carburizing, siliconizing, sulfurizing and boronizing steel surfaces. In the method of the present invention, it is possible to treat continuous extended lengths of tubular member interior surfaces with a pack composition which remains free-flowing even after treatment. That is, the pack composition of the present invention does not "adhere" after treatment, thereby allowing it to remain in powder form and free-flowing for easy removal from the interior of the tubular member.

In the method of the present invention, the pack composition used is non-adhering and free-flowing, and preferrably comprises:

i) between about 5% and 20% by weight of a suitable source of boron;

ii) between about 2% and about 10% by weight of silicon material;

iii) between about 2% and 15% by weight of an activator; and iv) between about 70% and 90% by weight of an non-adhering filler in the absence of a carburization activator.

The pack composition for use with the method of the present invention remains free-flowing and non-adhering due to the presence of a major amount of a non-adhering filler. Preferably, the non-adhering filler comprises non-sintering carbon, such as lamp black, graphitic carbon and charcoal. Alternatively, the non-adhering filler may comprise non-sintering ceramic or a non-sintering organic compound, such as sawdust or other solid hydrocarbons. Although the pack composition may contain carbon-containing compounds, essentially no carburizing occurs because the necessary carbonates, such as, calcium or sodium carbonate, are not present for the carburizing process.

In the method of the present invention, the pack composition comprises between about 70% and about 90% by weight of the non-adhering filler. Since the pack composition for use with the method of the present invention is substantially free of an activator for the carbon, carburization is minimized, and essentially eliminated. Thus, the pack composition remains in powdered form and remains substantially non-adhering allowing it to flow freely from the interior of a tubular member after treatment of the tubular member.

The pack composition also includes a suitable source of boron for creating a boronized layer on the interior surface of the tubular member. Preferably, the pack composition comprises between about 5% and about 20% of the suitable source of boron. Preferably, the boron is in the form of amorphous boron, or boron carbide.

The pack composition for use with the method of the present invention also preferrably includes a suitable silicon material, preferrably in an amount of between about 2% and about 10% by weight. A preferred type of silicon material is silicon carbide. An activator is also provided in the pack composition. The activator is used to assist in the chemical vapour deposition of the boron and/or silicon. Typically, the activator will be an alkali earth material, and preferably will be potassium borofluoride, sodium fluorosilicide, potassium fluoride or mixtures thereof. It is also appreciated that other diffusible elements may be used in combination with the preferred boron and silicon, such as, titanium, chromium, vanadium and the like.

In the method of the present invention, the interior surface of an extended length of tubular member is exposed to diffusible boron and silicon to enhance the wear, corrosion and abrasion resistance of the tubular member.

With the method of the present invention, at least one boronized or borosiliconized layer, and preferably more than one such layer is formed on the interior surface of the tube. As is the case with methods of the prior art, the transition between the base tubular member and the one or more formed layers is continuous and gradual.

The borosiliconized layer provides a coating or case for the surface of the ferrous metal tubular member that combines the attributes of each of boronizing and siliconizing. Boronizing creates a layer of exceptional hardness for wear resistance in the presence of silicon. Although such hardness in not involving the iron base metal hardness avoids hydrogen embrittlement problems. The siliconized layer provides excellent corrosion and acid resistance properties in the presence of boron. For example, silicon is particularly resistant to hydrogen sulfide and sulfuric acid, thereby preventing corrosion and essentially negating any hydrogen embrittlement that may occur.

In the method of the present invention, the surface to be treated is exposed to the pack composition and both are heated to a temperature where at least one boronized and preferrably siliconized layer are formed on the surface by chemical vapour deposition. Preferably, the temperature is in the range of from about 1500° F. to about 2400° F., and most preferably, the temperature is in the range from about 1600° F. to about 1900° F.

It has been found that for a tube that is no more than 6 inches in diameter, a boronized and siliconized layer of between about 0.002 inches and 0.02 inches can be formed on the interior surface by heating the pack composition and tube for between about 2 hours and about 20 hours.

An important feature of the method of the present invention is that the pack composition remains free-flowing. That is, the pack composition does not sinter or adhere during the treatment process, whereas the pack compositions of the prior art adhere and are not free-flowing after the heating cycle. Thus, the pack compositions of the prior art could not be easily removed from the interior of extended lengths of tubular members and therefore defeated any efforts to treat extended lengths of pipe.

In the following example, the method of the present invention was used to case harden the interior surface of a 31 foot long pipe. The pipe was made of 1018 steel and had a 2 inch inside diameter and 2.375 inch outside diameter. The 31 foot long pipe was treated with the method of the present invention and, following the heating and cooling cycles, the pack composition remained completely free-flowing and was easily removed from the interior of the pipe. Very little of the pack composition had "adhered", thereby permitting the pack composition to flow out of the interior of the pipe.

In the above example, the final hardness depth achieved was 0.016 inches. The final measured hardness of the layers was Diamond Pyramid 1790 or approximately R.C.80. The test slurry used was an oil-well fracking mixture with a density of 15 lbs. of sand per gallon of fluid. The treated pipe was tested in three separate stages as follows:

First Stage: 700,000 lbs. of sand at 35 BBLS per minute. Measured Wear: 0.01 inches.

Second Stage: 700,000 lbs. of sand at 45 BBLS per minute. Measured Wear: 0.0005 inches.

Third Stage: 600,000 lbs. of sand at 41 BBLS per minute. Measured Wear: 0.0000 inches. Thus, the total sand pumped during the test was 2,000,000 lbs. with a measured wear of less than 0.002 inches.

A steel pipe heated in accordance with this invention also exhibited excellent corrosion resistance to hydrochloric acid, sulfuric acid, hydrogen sulfide, hydrogen fluoride and salt water. The borosiliconized layer was found to provide an excellent barrier against oxygen, hydrogen and hydrogen sulfide.

In the example above, the pack composition consisted of between about 5% to 10% amorphous boron, about 5% to 10% silicon powder, about 5% to 15% alkali earth activator and about 75% to 85% of a non-sintering filler.

In summary, the present invention provides an improved method for treating the interior surface of continuous extended lengths of tubular members using a pack composition that is substantially free of diffusible carbon to minimize carburization of the interior surface. As well, the pack composition is substantially non-adhering thereby remaining free-flowing to allow easy removal of the pack composition after treatment.

Although preferred embodiments of the invention are described herein in detail, it will be understood by those skilled in the art that variations may be made thereto without departing from the spirit of the invention or the scope of the appended claims.

We claim:

1. In a chemical vapour deposition method for treating an interior surface of a ferrous tubular member to provide wear, abrasion and corrosion resistance to the interior surface, comprising:

a) providing a pack composition including boron, a silicon material, an activator and diffusible carbon;

b) exposing said interior surface to said pack composition;

c) heating said pack composition to a temperature where at least one carburized, boronized and siliconized layer is formed on said interior surface by chemical vapour deposition and where said pack composition adheres;

d) cooling said adhered pack composition; and e) removing said adhered pack composition from said tubular member by breaking up said adhered pack composition, the improvement for treating continuous extended lengths of tubular member interior comprising;

f) providing a non-sintering, non-adhering, free-flowing powder pack composition, comprising:

i) between about 5% and about 20% by weight of a suitable source of boron;

ii) between about 2% and about 10% by weight of silicon material;

iii) between about 2% and about 15% by weight of an activator; and iv) between about 70% and about 90% by weight of a non-sintering, non-adhering filler selected from the group consisting of non-sintering carbon and non-sintering organic compounds;

wherein said powder pack composition is substantially free of diffusible carbon thereby minimizing carburization of said interior surface of said tubular member in the presence of the selected carbon based filler, and said powder pack composition is substantially non-sintering and non-adhering thereby remaining free-flowing after said heating and cooling steps, such free-flowing pack composition permitting the treatment of continuous lengths of said interior surface of said tubular member whereby said pack composition flows from said tubular member interior after said treatment.

2. In the method of claim 1, said non-sintering carbon being selected from the group consisting of lamp black, graphitic carbon and charcoal.

3. In the method of claim 1, said non-sintering organic compound being selected from the group consisting of sawdust and solid hydrocarbons.

4. In the method of claim 1, said silicon material comprising silicon carbide.

5. In the method of claim 1, said activator being an alkali earth material which in absence of carbonates, avoids forming iron carbides.

6. In the method of claim 5, said alkali earth material comprising sodium fluorosilicide.

7. In the method of claim 5, said alkali earth material comprising potassium fluoride.

8. In the method of claim 5, said alkali earth material comprising potassium borofluroide.

9. In the method of claim 1, said suitable source of boron being amorphous boron.

10. In the method of claim 1, said suitable source of boron being boron carbide.

11. In the method of claim 1, said temperature being in the range from about 1500° F. to about 2400° F.

12. In the method of claim 11, said temperature being in the range from about 1600° F. to about 1900° F.

13. In the method of claim 1, said free-flowing pack composition being heated to said temperature for between about 2 hours and about 20 hours so that said boronized and siliconized layer formed on said surface is between about 0.002 inches and about 0.02 inches thick where said tubular member is no more than 6 inches in diameter.

* * * * *